US006390959B1

(12) United States Patent
Tornabene et al.

(10) Patent No.: US 6,390,959 B1
(45) Date of Patent: May 21, 2002

(54) EXERCISE APPARATUS

(76) Inventors: Dean Tornabene, 4015 Glenco Ave. Unit No. 8, Marina Del Rey, CA (US) 90292; Charles Perez, 530 Brooks Ave., Vinice, CA (US) 09291

( * ) Notice: Subject to any disclaimer, the term of this patent is extended or adjusted under 35 U.S.C. 154(b) by 0 days.

(21) Appl. No.: 09/855,915

(22) Filed: May 16, 2001

(51) Int. Cl.[7] ..... A63B 21/02
(52) U.S. Cl. ..... 482/126; 482/122; 482/125
(58) Field of Search ..... 482/121–126, 482/148, 44–49

(56) References Cited

U.S. PATENT DOCUMENTS 1,620,910 A * 3/1927 Minnich
3,544,106 A * 12/1970 Barrett ..... 272/83
4,406,453 A * 9/1983 Herzfeld ..... 482/126
4,428,577 A 1/1984 Weingardt
4,489,937 A 12/1984 Kong
5,569,137 A 10/1996 Uen

* cited by examiner

*Primary Examiner*—Stephen R. Crow
(74) *Attorney, Agent, or Firm*—Howard A. Kenyon

(57) ABSTRACT

An Exercise Apparatus having two parallel springs attached to a frame on each end. The frame is spaced apart by a rotating hand grip located at the end of each spring. The frame has a predetermined length, and is also spaced apart by a rotating band that fits around the forearm of the exerciser. The exercise apparatus exercises the pectoral, arm and back muscles as the exercise apparatus is held in front of the exerciser and the hands while on the hand grip are pulled toward each other. Other exercise positions can be used to exercise the muscles of the chest and the back and are described herein.

11 Claims, 3 Drawing Sheets

EXERCISE APPARATUS

BACKGROUND OF THE INVENTION

1. Field of the Invention

This invention relates to an exercise apparatus to exercise the upper body and more particularly to an exercise apparatus for the conditioning of the arm and pectoral muscles of the chest.

2. Description of the Prior Art

Many devices exist for exercising various parts of the body for commercial and home use. Some of these devices are:

U.S. Pat. No. 5,569,137 to Samuel Uen. This devise has two handles on each end of an elastic rope. Two hand grips are on each end of the exercise device. A resilient member, preferably a hollow spring, is part of the device. The device can be used for exercising in many ways.

U.S. Pat. No. 4,428,577 to Wifred Welnardt. This devise has a flexible steel blade having a plurality of hand grips. The exerciser grips a handle and pulls the hands toward each other which exercise the arm and pectoral muscles.

U.S. Pat. No. 4,489,937 to Kong. This patent describes a safety device where an exercise apparatus uses spring steel coils. The safety device is a steel cable running through the middle of the spring steel coil with attaching means on each end of the steel cable.

Accordingly, a fuller understanding of the invention may be obtained by referring to the summary of the invention, and the Detailed Description of the Preferred Embodiment, in addition to the scope of the invention defined by the claims taken in conjunction with the accompanying drawings.

SUMMARY OF THE INVENTION

It is the object of the present invention to provide an exercise apparatus that will exercise the arm, pectoral and back muscles.

It is another object of the present invention to provide an exercise apparatus that is portable.

It is yet another object of the present invention to provide an exercise apparatus that can be efficiently and economically manufactured.

Briefly, in accordance with the present invention there is provided an exercise apparatus that has two hand grips spaced apart on a frame, the frame having two hollow springs attached to each end of the frame. Two rotating forearm bands are also spaced apart on each end of the frame. The springs having an internal cable attached to each end of the frame provide safety means in case the hollow springs fail. This safety means is described in U.S. Pat. No. 4,489,937 to Kong and is herein incorporated by reference. When a person holds the exercise apparatus and places the hands on the hand grips and brings the hands toward each other, this action will force the forearm bands inward and provide a stress in the arm muscles and pectoral muscles. The exerciser brings the hands toward each other just as far as the exerciser is capable or desires and when the exerciser relaxes the exercise apparatus will return to the normal position. The exerciser repeats this motion until a complete workout is obtained.

Additional exercises that can be performed by the present invention are: triceps pushdowns; shoulder press; chest fly; biceps curl; back row; and bench press. These secondary exercises will be described on the Description of the Preferred Embodiment.

These and other objects, features and advantages of the present invention will become more apparent upon detail consideration of the following Description of the Preferred Embodiment with reference to the accompanying drawings.

DESCRIPTION OF THE DRAWINGS

The drawings that illustrate the best mode presently contemplated for carrying out the present invention are.

The novel features which are believed to be characteristic of the invention, both as its organization and its method of operation, together with further objects and advantages thereof, will be better understood from the following description in connection with accompanying drawings in which a presently preferred embodiment of the invention is illustrated by way of example. It is expressly understood, however, that the drawings are for purposes of illustration and description only and are not intended as a definition of the limits of the invention.

DESCRIPTION OF THE PREFERRED EMBODIMENT

Figure 1:
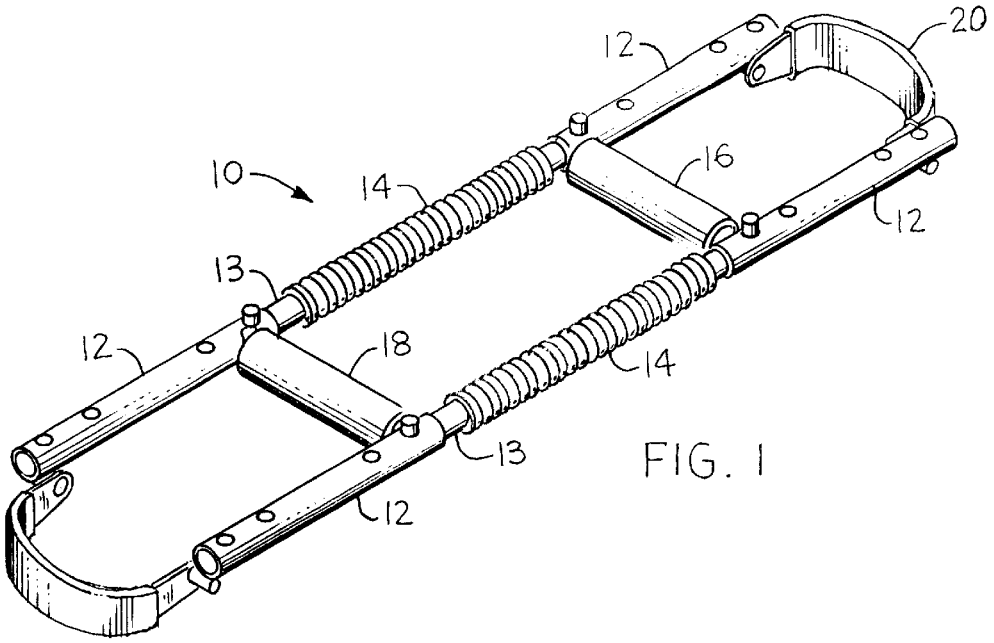
FIG. 1 is an isometric view of the present invention.

Turning now to FIG. 1 there is seen a perspective view of the present invention generally shown as 10. The frame 12 is made from a hollow material such as a suitable gage steel. Attached to one end of frame 12 are two hollow springs 14. Holding the frame 12 spaced apart are two rotatable hand grips 16 and 18. The hand grips 16 and 18 are captured and rotate on pins (not shown) attached to frame 12. The hand grips are covered with a resilient material to provide a good grip. Also holding the frame 12 spaced apart are two arm bands 20 and 22. These arm band are also captured and rotate on pins (not shown) between the frame 12. The arm bands are covered with a soft material to provide comfort to the exerciser.

Figure 2:
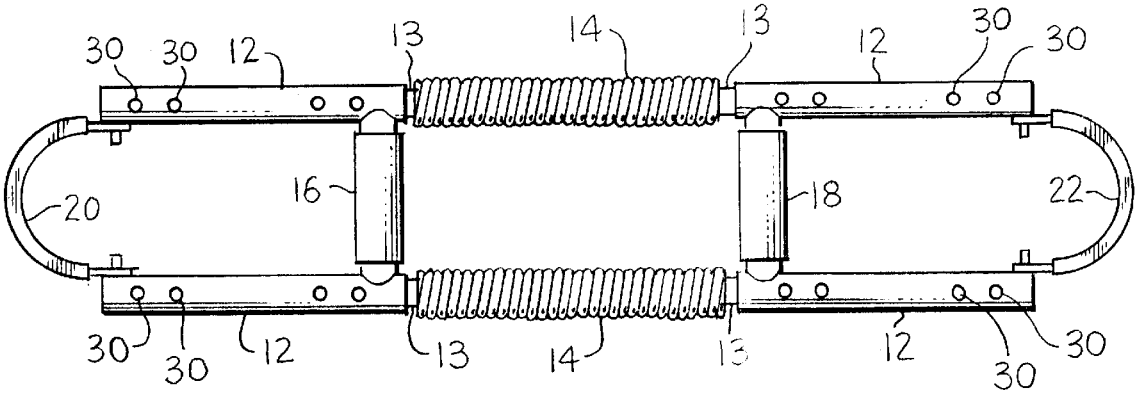
FIG. 2 is a plan view of the present invention.

FIG. 2 shows a plan view of the present invention. In this view there is also seen the frame 12, the hollow springs 14, the hand grips 16 and 18, and the arm bands 20 and 22.

Figure 3:
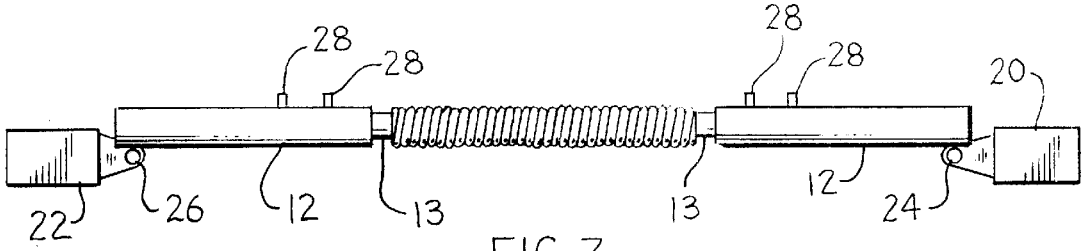
FIG. 3 is a side view of the present invention.

FIG. 3 shows a side view of the present invention. In this view there is seen the frame 12, the spring 14 and the arm bands 20 and 22. In this view there is also seen the means that provide the rotation of the arm bands 20 and 22 which are pin 24 and 26. Also seen in FIG. 3 and in FIG. 2, it is noted that frame 12 can be expanded to accommodate persons of larger stature. Frame 12 slides on frame 13 and spring biased pins 28 are fitted in holes 30. The holes 30 can be better seen in FIG. 2.

Figure 4:
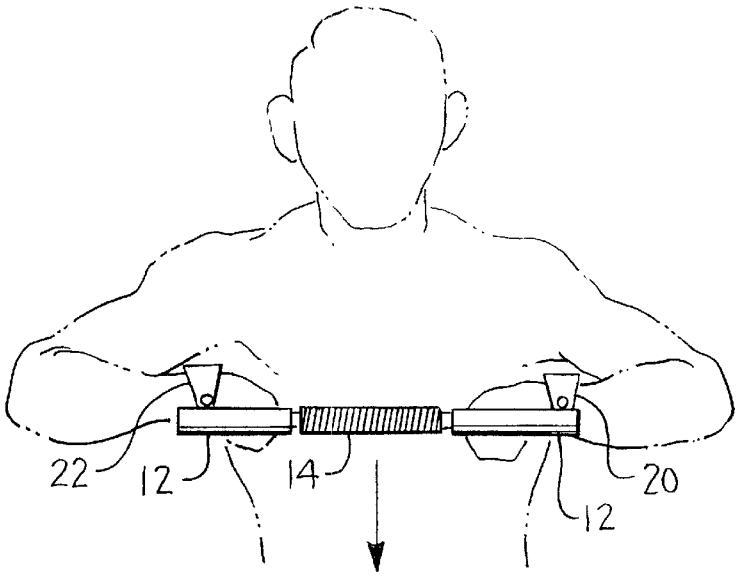
FIG. 4 shows how the present invention exercises the triceps muscles.

FIG. 4 shows how the triceps muscles are exercised with the present exercise apparatus. The arm bands 20 and 22 are placed on the back on the arm and the hand grips 16 and 18 are gripped as shown in FIG. 4. The exerciser then pushes down and this movement allows the springs 14 to provide tension while bending and exercises the triceps muscle.

Figure 5:
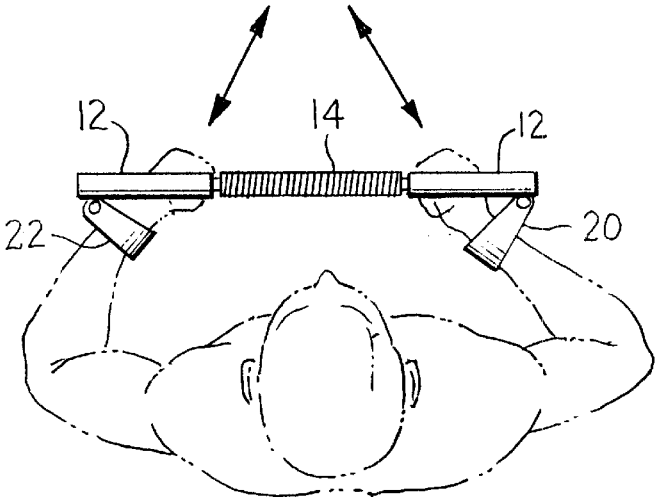
FIG. 5 shows how using the present invention the exerciser simulates the bench press.

FIG. 5 shows how the pectoralis muscles are exercised with the present exercise apparatus. The arm bands 20 and 22 are placed on the inside of the arm and the hand grips 16 and 18 are griped as shown in FIG. 5. The exerciser then pushes outward and this movement allows springs 14 to provide tension while bending and exercises the pectoralis muscles.

Figure 6:
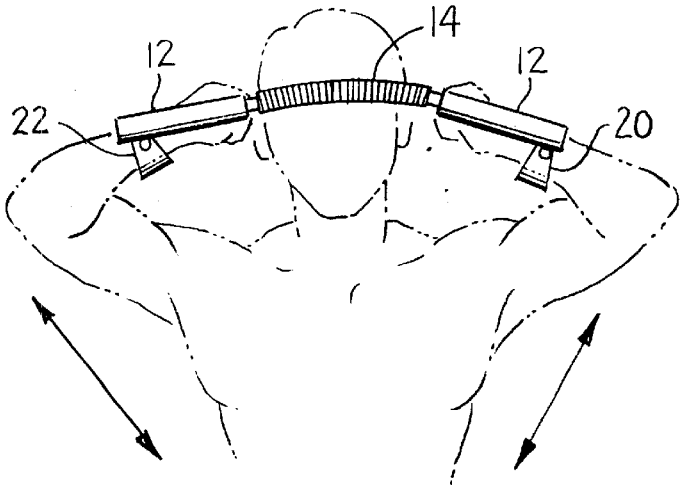
FIG. 6 shows how using the present invention the exerciser simulates the chest fly.

FIG. 6 shows how the deltoid muscles are exercised with the present exercise apparatus. The arm bands 20 and 22 are placed on the inside of the arm and the hand grips 16 and 18 are gripped as shown in FIG. 6. The exerciser then pulls the elbows toward the chest and this movement allows the spring 14 to provide tension while bending and exercises the deltoid muscles.

Figure 7:
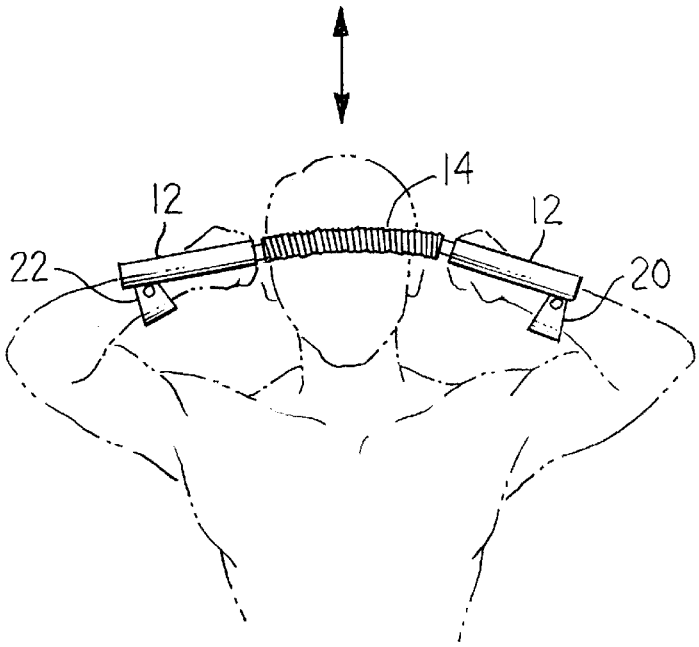
FIG. 7 shows how using the present invention the exerciser simulates the shoulder press.

FIG. 7 shows the combination deltoid and triceps muscles that are exercised with the present exercise apparatus. The arm bands 20 and 22 are placed on the inside of the arm and the hand grips 16 and 18 are placed as shown in FIG. 7. The exerciser then pushes up and this movement allows the springs 14 to provide tension while bending and exercises the combination deltoid and triceps muscle.

Figure 8:
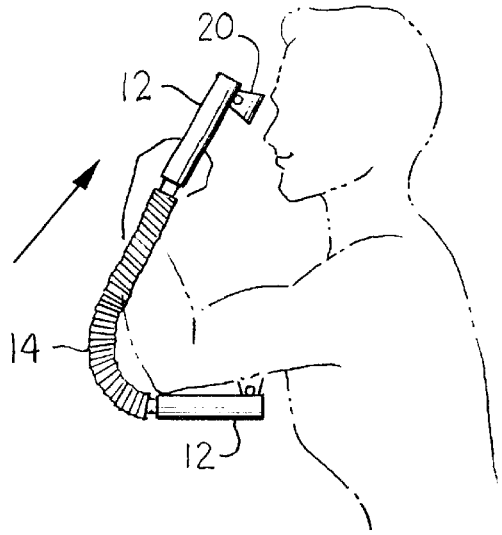
FIG. 8 shows how using the present invention the exerciser simulates the biceps curl.

FIG. 8 shows how the biceps muscle is exercised with the present exercise apparatus. One end of the exercise apparatus is placed on a flat surface and the exercisers elbow is place on the arm band 20 or 22. The exerciser grips the other arm band as shown in FIG. 8. The exerciser pulls the hand toward the body which allows the spring 14 to bend which provides tension in spring 14 and exercises the biceps muscle.

Figure 9:
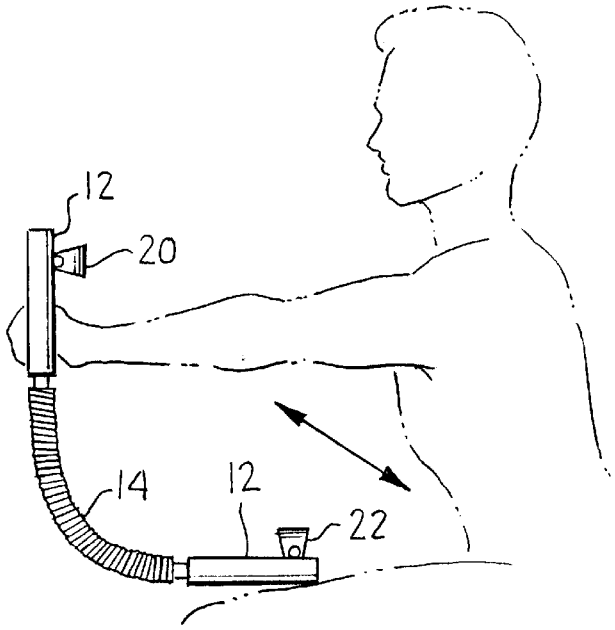
FIG. 9 shows how using the present invention the exerciser simulates the back row.

FIG. 9 shows how the group of back muscles are exercised with the present exercise apparatus. One end of the exercise apparatus is placed on a leg of the exerciser and the exerciser grips the remaining arm band 20 or 22. The exercises pulls the hand toward the body which allows the spring 14 to bend which provides tension in spring 14 and exercises the group of back muscles.

Thus, it is apparent that there has been provided in accordance with the invention, an exercise apparatus that fully satisfies the objectives, aims, and advantages set forth above. While the invention has been described in conjunction with specific embodiments thereof, it is evident that many alternatives, modifications, and variations will be apparent to those skilled in the art in light of the aforegoing description. Accordingly, it is intended to embrace all such alternatives, modifications, and variations that fall within the spirit and scope of the appended claims.

What is claimed is:

1. An exercise apparatus comprising:

left and right round frame members each comprising a pair of spaced apart tubular members each having a pair of telescoping members and spring biased pins for adjusting the lengths of each telescoping member;

a pair of hand grips attached between the medial ends of said round frame members;

a pair of arm bands attached between the distal ends of said round frame members; and spring resilient members connected between the left and right round frame members for providing exercise resistance.

2. An exercise apparatus as described in claim 1 wherein said hand grips are covered with a resilient material to provide a positive gripping surface.

3. An exercise apparatus as described in claim 1 wherein said hand grips rotate between said round frame members.

4. An exercise apparatus as described in claim 1 wherein said arm bands rotate between said round frame members.

5. An exercise apparatus as described in claim 1 wherein said arm bands are made from a hard material such as spring steel and are covered with a soft material to provide comfort.

6. An exercise apparatus as described in claim 1 wherein said exercisers can simulate a triceps push-down exercise.

7. An exercise apparatus as described in claim 1 wherein said exercisers can simulate a bench press exercise.

8. An exercise apparatus as described in claim 1 wherein said exercisers can simulate a chest fly exercise.

9. An exercise apparatus as described in claim 1 wherein said exercisers can simulate a should press exercise.

10. An exercise apparatus as described in claim 1 wherein said exercisers can simulate a biceps curl exercise.

11. An exercise apparatus as described in claim 1 wherein said exercisers can simulate a back row exercise.

* * * * *